US005524616A

United States Patent [19]

Smith et al.

[11] Patent Number: 5,524,616

[45] Date of Patent: Jun. 11, 1996

[54] METHOD OF AIR FILTRATION FOR FIRE FIGHTER EMERGENCY SMOKE INHALATION PROTECTION

[75] Inventors: Dennis Smith, Southampton, N.Y.; Frances G. Morton, North Palm Beach; Karen Nelson, Palm Beach Gardens, both of Fla.

[73] Assignee: LifePro, Inc., West Palm Beach, Fla.

[21] Appl. No.: 379,339

[22] Filed: Jan. 27, 1995

Related U.S. Application Data

[63] Continuation-in-part of Ser. No. 299,926, Aug. 31, 1994, abandoned.

[51] Int. Cl.[6] ..... A62B 23/02; A62B 25/00; A62B 18/08

[52] U.S. Cl. ..... 128/205.27; 128/205.29; 128/202.22

[58] Field of Search ..... 128/202.22, 201.22, 128/201.23, 201.24, 201.25, 201.26, 202.27, 205.27, 205.28, 205.29, 202.25, 206.12, 206.16, 206.17, 206.21, 206.28, 206.29, 205.23

[56] References Cited

U.S. PATENT DOCUMENTS

| | | | |
|---|---|---|---|
| 1,537,519 | 5/1925 | Yablick | 55/DIG. 33 |
| 2,450,610 | 10/1948 | Pierce | 128/204.18 |
| 2,610,624 | 9/1952 | Haller et al. | 128/205.29 |
| 3,653,581 | 4/1972 | Ptok . | |
| 3,731,678 | 5/1973 | Pyzel . | |
| 3,908,649 | 9/1975 | Eckstein . | |
| 4,154,235 | 5/1979 | Warncke | 128/201.25 |
| 4,154,586 | 5/1979 | Jones et al. . | |
| 4,155,358 | 5/1979 | McAllister et al. | 128/146.6 |
| 4,276,982 | 7/1981 | Sibrara et al. . | |
| 4,467,795 | 8/1984 | Eckstein . | |
| 4,468,811 | 8/1984 | Shaw et al. . | |

(List continued on next page.)

FOREIGN PATENT DOCUMENTS

| | | | |
|---|---|---|---|
| 1434909 | 10/1968 | Germany . | |
| 1282469 | 7/1969 | Germany . | |
| 2926728 | 2/1981 | Germany . | |
| 2609034B2 | 4/1981 | Germany . | |
| 2948423/C2 | 12/1982 | Germany . | |
| 3405098A1 | 8/1985 | Germany . | |
| 3507486C2 | 1/1987 | Germany . | |
| 4220780C1 | 9/1993 | Germany . | |
| 2223683 | 4/1990 | United Kingdom | 128/205.29 |

OTHER PUBLICATIONS

Drager Review 32 pp. 28–33.
Drager Review 25 pp. 12–15.
Drager Review 23 pp. 17–20 Sep. 1970.
Drager Review 25 pp. 1–9.
Lab Safety Supply, 1994 General Catalog, Winter/Spring Edition.
Drager Review 27 pp. 6–8.
Drager Review 10 pp. 20–23.
Drager Review 40 pp. 1–8.
Drager Review 9 pp. 12–16.
Drager Review 31 pp. 8–16 Sep. 1973.

*Primary Examiner*—Edgar S. Burr
*Assistant Examiner*—Dan Colilla
*Attorney, Agent, or Firm*—Quarles & Brady

[57] ABSTRACT

A method of emergency smoke inhalation protection of fire fighters in imminent life-threatening situations includes configuring a canister containing a filter medium to evidence use. The canister has an opening through which air enters and has a coupling for attachment to the mask of a standard self contained breathing apparatus in place of a connection to an air tank. When so connected, air drawn into the mask passes through the filter medium within said canister. A use-evidencing mechanism is operatively connected to the canister to indicate use of the air filtering system. This mechanism can be non-reusable covers applied over the opening and coupling, or a sealed package containing the air filtering system. Such devices provide an indication of previous use of the filtering system and inhibit a fire fighter from using the system in an unauthorized manner.

18 Claims, 5 Drawing Sheets

U.S. PATENT DOCUMENTS

| | | | |
|---|---|---|---|
| 4,473,072 | 9/1984 | Walther . | |
| 4,475,661 | 10/1984 | Griffin . | |
| 4,488,547 | 12/1984 | Mason | 128/202.22 |
| 4,562,837 | 1/1986 | Schlobohm . | |
| 4,726,365 | 2/1988 | Jablonski | 128/202.13 |
| 4,745,730 | 5/1988 | Bastle, Sr. . | |
| 4,818,120 | 4/1989 | Addiego . | |
| 4,926,398 | 5/1990 | Finches . | |
| 4,926,854 | 5/1990 | Bode | 128/201.23 |
| 4,934,361 | 6/1990 | Michel et al. . | |
| 5,005,700 | 4/1991 | Rohling et al. . | |
| 5,007,421 | 4/1991 | Stewart | 128/204.18 |
| 5,186,165 | 2/1993 | Swann | 128/201.25 |
| 5,291,880 | 3/1994 | Almovist et al. | 128/201.24 |

METHOD OF AIR FILTRATION FOR FIRE FIGHTER EMERGENCY SMOKE INHALATION PROTECTION

CROSS-REFERENCE TO RELATED APPLICATION

This is a continuation-in-part of U.S. patent application Ser. No. 08/299,926, filed Aug. 31, 1994 now abandoned.

BACKGROUND OF THE INVENTION

The present invention relates to fire fighting safety methods, and more particularly to techniques for protecting fire fighters against smoke inhalation in imminent life-threatening situations.

Breathing masks are often worn by workers in hazardous environments. One type of such a mask extends only over a user's nose and mouth, and contains a charcoal filter through which the air being breathed passes. The filter removes particles and toxic gases from the air. However, use of this type of breathing apparatus is typically prohibited by most fire departments as being inadequate, unreliable or unsafe in many environments where fire and smoke are present.

Instead, fire fighters are commonly approved to use safer self-contained breathing equipment when entering burning buildings. Such equipment includes a tank of compressed air and a pressure regulator to supply air at a constant pressure that can be tolerated by the fire fighter. A hose connects the air regulator to a full-face mask that is worn over the fire fighter's face. The mask includes an outlet for air exhaled by the fire fighter and a transparent visor. When worn by the user, the mask not only provides a sealed volume of breathable air over the user's face, but also protects the fire fighter's eyes from the smoke. Self-contained breathing apparatus with a full-face mask typically is the only type of smoke inhalation prevention equipment that is authorized by a fire department.

The tank of the fire fighter's breathing equipment has a finite supply of air. Although warning mechanisms are provided to alert the fire fighter when the supply of air is running low, there always is the possibility that the fire fighter will not be able to exit the burning structure before the exhaustion of the air supply. There is also a possibility that a fire fighter may become trapped within a burning structure, due to structure collapse, for example. The fire fighter may become lost in a large smoke-filled area, such as a shopping mall. The fire fighter could also be injured or incapacitated in someway and rendered immobile. In these instances, the fire fighter can run out of breathable air and be in imminent danger of death. As a consequence, it is desirable to provide an alternative breathing apparatus that protects against smoke inhalation for use in such imminent life-threatening emergencies.

Although a charcoal filter-type mouth filter could be provided to fire fighters for emergency back-up to authorized self-contained breathing apparatus, fire department officials are often concerned that such masks will be used routinely in the normal course of fire fighting and not reserved for imminent death situations, and therefore prohibit their use outright. Accordingly, it is desirable to provide a way of issuing back-up breathing devices to fire fighters in a manner which restricts their use to true emergency imminent death situations. It is also desirable to provide a mechanism by which fire fighters can quickly identify previous use and fire department officials can detect the unauthorized use of such emergency breathing devices.

SUMMARY OF THE INVENTION

A general object of the present invention is to provide a reliable emergency breathing system and a process to protect fire fighters from smoke inhalation in last resort, imminent death situations in a manner that inhibits use of such equipment in the ordinary course of fire fighting.

Another object is to provide a use-evidencing container for use in an emergency breathing method which provides a clear indication that the apparatus has been used.

A further object of the invention is to provide a method for storing the emergency device in a durable and moisture resistant manner for long term dormancy.

A still further object of the invention is to provide a method of emergency air filtering that can quickly be applied by an endangered fire fighter.

These objects are achieved by an emergency air filtering method for protecting a fire fighter from smoke and hazardous chemical inhalation in imminent life-threatening situations. It is recognized that all fire fighting experiences are life-threatening to varying degrees. As used throughout this specification and associated claims, the terms "imminently life-threatening" or "imminent death situations" are used to describe those instances during fire fighting in which a fire fighter realizes that circumstances have placed him in imminent and impending danger of death. These terms are intended to distinguish from the ordinary course of normal fire fighting in which a fire fighter is aware of options and opportunities to remain secure against death while performing his fire fighting tasks.

The invention provides a method of using a compact emergency air filtering device that can be attached to the mask of a conventional self-contained breathing apparatus. The air filtering device comprises a canister having at least one opening through which air can enter and a coupling for attachment to the mask to supply air to the user. A filter is contained within the canister through which air passes between the opening and the coupling.

In an imminent life-threatening situation, such as when the air in the tank of the standard self-contained breathing apparatus is depleted, the fire fighter uncouples the air tank from the mask. The emergency air filtering device then is attached either directly to the mask or to the remote end of the air supply hose in place of the tank. When the fire fighter inhales, air is drawn into the mask through the canister where the filter cleanses the air. The small, compact nature of the emergency air filter system allows convenient long term storage of the gear of the fire fighter and rapid application in an imminent life-threatening situation.

A use-evidencing mechanism is associated with the canister to indicate possible previous use of the air filtering device. Such mechanism is constructed or configured to visually reveal that canister has been arranged for operation and to prevent rearrangement to the previous, unused condition and appearance. This mechanism may take any one of several forms. In one embodiment, the use-evidencing mechanism can comprise a package that is closed with a non-reusable closure or which is vacuum sealed to provide evidence, when opened, that the air filtering device stored therein has been used. The vacuum sealed package also can provide resistance against moisture that otherwise undermines the effectiveness of the filter medium.

In another embodiment, self-adhesive covers can be applied over the opening and the coupling of the canister. The adhesive used will not permit the covers to be reapplied over the opening and coupling once the covers have been removed. Alternatively, use-evidencing tape, that leaves a message bearing residue or the like, can be used as the covers.

The present invention allows the prior use of the breathing device to be visually detected and to be monitored by fire fighter supervising personnel, thereby discouraging unauthorized use for other than imminent death situations.

DETAILED DESCRIPTION OF THE INVENTION

Figure 1:
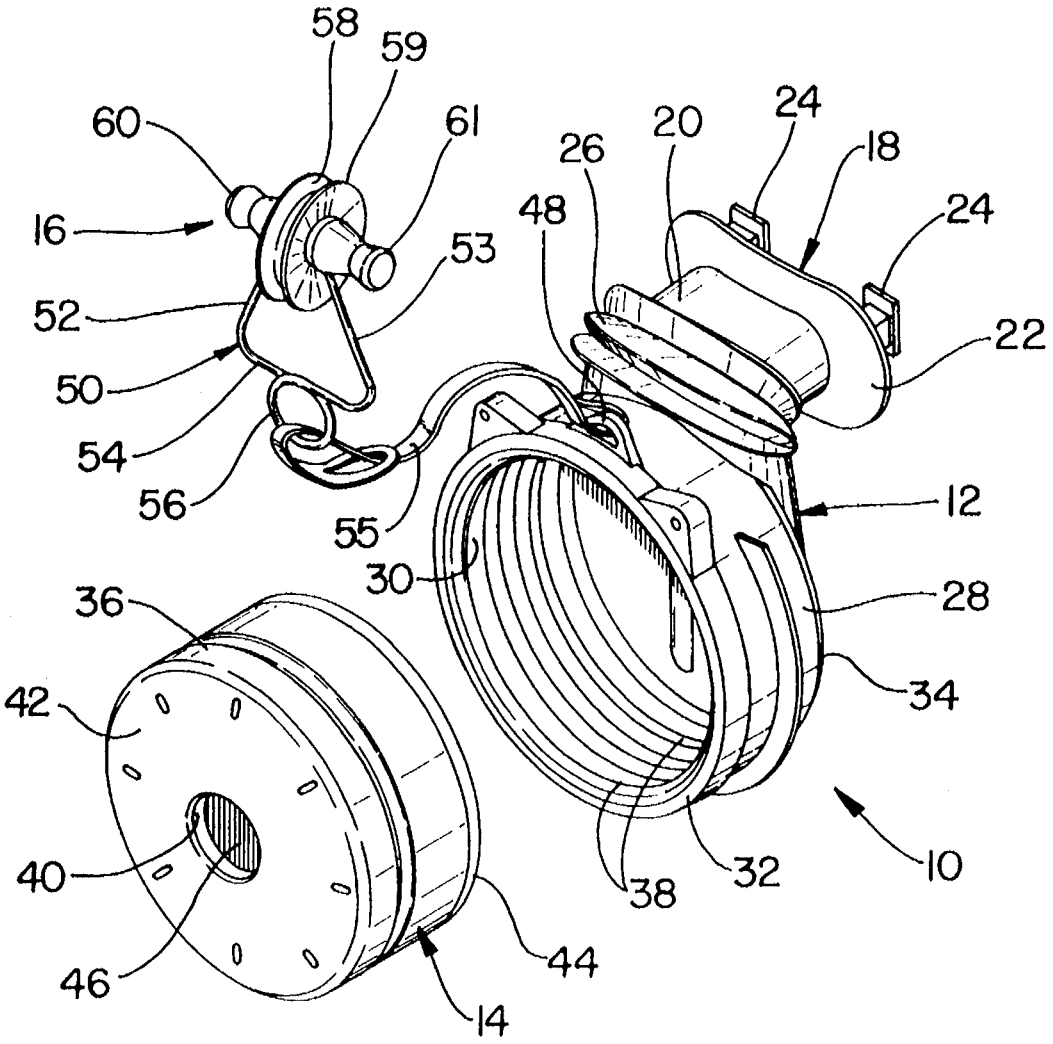
FIG. 1 is an exploded, isometric view of an emergency breathing apparatus according to the present invention.

The invention is directed to a method for providing fire fighters with an emergency device for providing breathable air when a standard breathing source such as a self-contained breathing apparatus is exhausted. This method is intended to provide the fire fighter a few extra minutes of breathing to escape the imminently life threatening situations. The invention also resides in the step of configuring the breathing device to be use-evidencing so as to provide an accountability of the use by the fire fighter. With initial reference to FIG. 1, the method can be accomplished, for example, by an emergency personal air filtering device 10 including a housing 12, a filter cartridge 14 and a nose clip 16. The assembly of these components provides a relatively small and hoodless device which can be carried easily by a fire fighter for use in imminent life-threatening situations, such as an unexpected failure of standard self-contained breathing equipment.

As discussed earlier, it is recognized that all fire fighting experiences are, to varying degrees, life-threatening. As used throughout this specification and the associated claims, the terms "imminently life-threatening" or "imminent death situations" are used to describe those instances during fire fighting in which the fire fighter realizes that circumstances have placed him in imminent and impending danger of death. These terms are intended to distinguish from the ordinary course of normal fire fighting in which a fire fighter is aware of options and opportunities to remain secure against death while performing his fire fighting tasks.

The compact nature of the air filtering device 10 also makes it easy to insert into a mouth as application of a large hood or mask over the head of the user is not required. This convenient and rapid use offsets any delay created by a use-evidencing covering, discussed more fully below.

The housing 12 is formed of moldable plastic or rubber and has a mouthpiece 18 that includes an oval-shaped tube 20 with a radial flange 22 extending around one end of the tube. A pair of teeth grips 24 project from the side of the flange 22 that is remote from tube 20. In use, the mouthpiece 18 is inserted into the fire fighter's mouth so that the flange 22 is between the lips and the teeth with lips tightly sealed around the tube 20.

An air duct 26 extends from the tube 20 of the mouthpiece 18 and has accordion walls allowing the air duct to assume the form of an easily flexible 90° elbow. An end of the air duct 26, that is remote from the mouthpiece 18, is connected to an opening at the top of a plenum 28 of the housing 12. The plenum 28 has a hollow cylindrical shape defining an interior plenum chamber 30 with an open front end 32 and a closed rear end 34. The air duct 26 and tube 20 provide an air passage between the plenum chamber 30 and the outlet of mouthpiece 18 through which the user is able to breathe.

The plenum chamber 30 has a circular cross section adapted to receive a cylindrically-shaped filter cartridge 14. When the filter cartridge 14 is placed into the plenum chamber 30, the outer circumferential surface 36 tightly engages a pair of ribs 38 within the plenum chamber. The resiliency of the plenum 28 and specifically the ribs 38 provide an air tight seal around the exterior of the filter cartridge 14. Securing the filter cartridge in the plenum chamber 30 effectively closes the open end 32 of the plenum.

The filter cartridge 14 is of a conventional design having an inlet 40 in a front surface 42 and an outlet (not shown) in a rear surface 44. A charcoal filter element 46 is contained within the filter cartridge 14 through which air flows between the inlet and the outlet. The charcoal filter element 46 removes particles, such as smoke, and hazardous vapors from the air passing through the filter cartridge. The filter element can also include hopkolite to convert noxious carbon monoxide to a harmless gas. The filter can be any of a variety of type, but it is preferred that the filter be designed to filter and convert air filled with large quantities of carbon monoxide to breathable air.

The mouthpiece 18, air duct 26 and plenum chamber 30 when closed by the filter cartridge 14 form an enclosure through which air being breathed by a user flows. When the user inhales, air is drawn through filter cartridge 14 and into a chamber at the rear of the plenum 28 between the filter cartridge and rear end 34. The air then travels upward into the air duct 26 and the mouthpiece tube 20. Finally, the air exits the air filtering device 10 and into the user's mouth through the opening 76 in the remote end of the mouthpiece tube 20 that is surrounded by flange 22 as illustrated in FIG. 3B. When the user exhales, air flows through the air filtering device 10 in the reverse direction.

Figure 2:
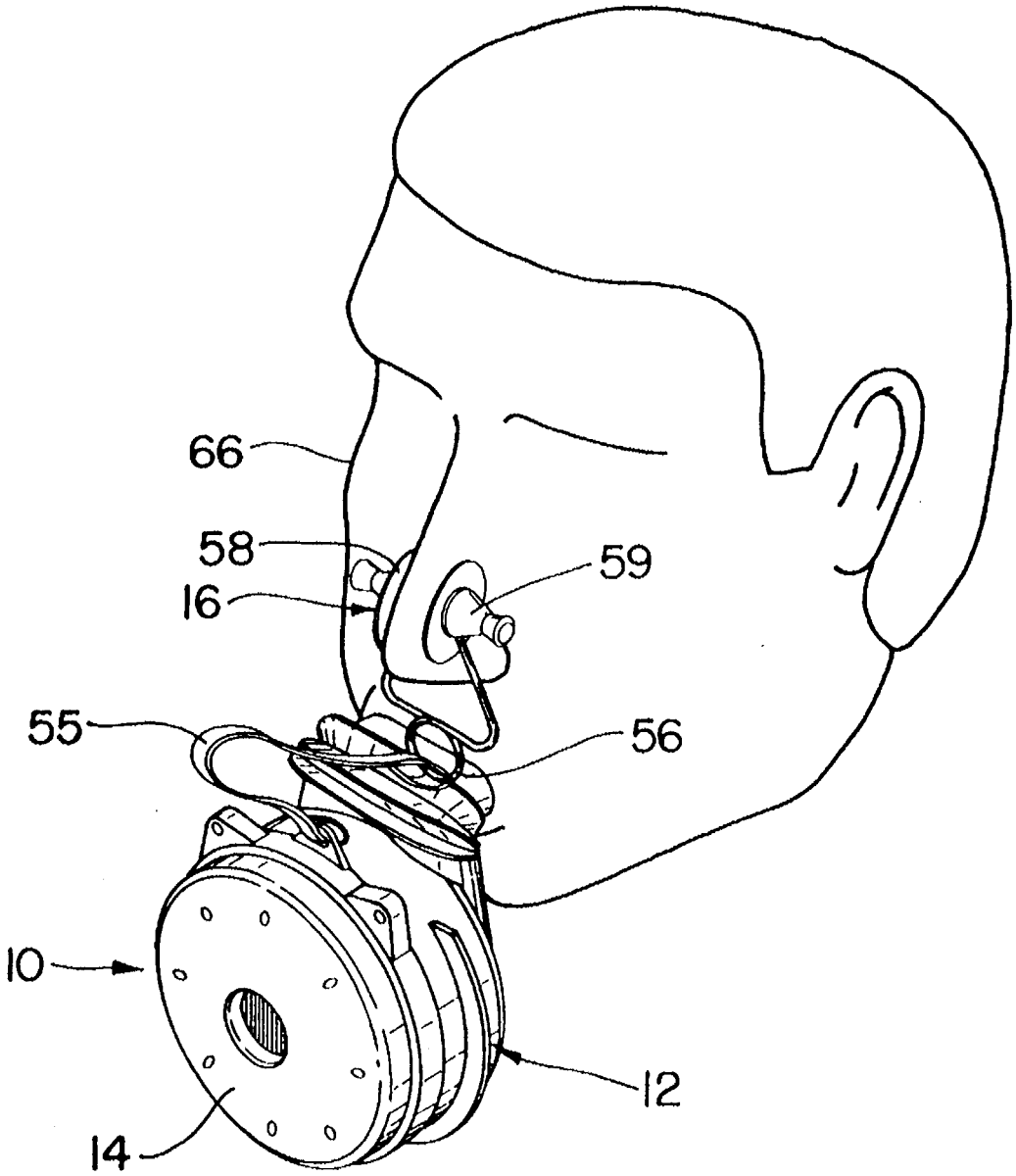
FIG. 2 illustrates the use of such emergency breathing apparatus by an individual.

By wearing the nose clip 16 shown in FIG. 1 and 2, ambient air is prevented from flowing through the user's nostrils when using the air filtering device 10. The nose clip 16 has a spring clip 50 with a pair of legs 52 and 53 connected by a cross member 54 that includes a torsion spring 56. The ends of the legs 52 and 53 which are remote from the cross member 54 are attached to separate mushroom-shaped nose depressors 58 and 59. The force provided by torsion spring 56 on legs 52 and 53 causes the nose depressors 58 and 59 to abut one another when the device is not in use. Each nose depressor 58 and 59 has a stem 60 and 61, respectively, which can be grasped by the user for installation and removal of the nose clip 16. A leash 55 has a loop at one end that passes through the torsion spring 56 and a loop at another end which passes through a bracket 48 at the exterior top of the plenum 28. The leash 55 attaches the nose clip 16 to the housing 12.

The nose clip 16 and leash 55 also serve to maintain connection between the filter and the user. If the mouthpiece is inadvertently dropped from the mouth, the nose clip 16 can retain the filter in proximity of the face for prompt reinsertion. This feature can be lifesaving as the user may not be able to relocate a filter dropped to the ground in a smoke-filled area.

Referring to FIG. 2, the fire fighter 66 inserts the mouthpiece 18 in his mouth so that the flange 22 is located between the lips and the teeth with the teeth grips 24 between the teeth of upper and lower jaws. The fire fighter closes the teeth on the grips 24 to hold the mouthpiece in place and the thickness of the grips provide a gap between the teeth through which air being breathed passes. The nose depressors 58 and 59 are pulled apart by grasping the stems 60 and 61 and placed over the nose. The fire fighter 66 then gently releases the nose depressors 58 and 59. The force provided by the torsion spring 56 presses the depressors 58 and 59 against the sides of the nose closing the nostrils.

To reserve the smoke filter to imminent life-threatening situations, the apparatus of the invention includes a use-evidencing mechanism operatively connected to the filter. The use-evidencing mechanism is constructed or configured to visually reveal that the mouthpiece and filter have been arranged for operation and to prevent rearrangement to the previous, unused condition and appearance.

Figure 3A:
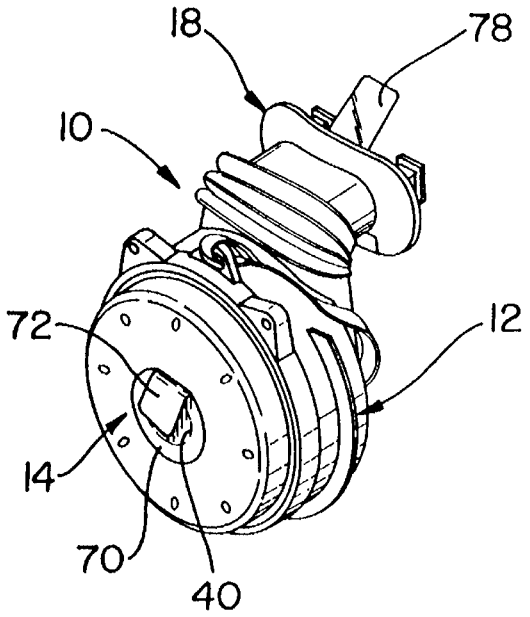
FIG. 3A is an isometric view of an assembled breathing apparatus with use-evidencing covers over the air inlet and outlet.
Figure 3B:
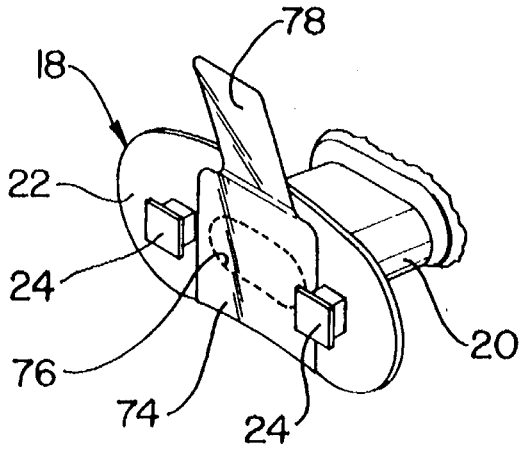
FIG. 3B illustrates the mouthpiece of the breathing apparatus with a use-evidencing removable cover in place.

In FIG. 3A, the air filtering device 10 is assembled for use with the filter cartridge 14 inserted into the plenum chamber of housing 12. The use-evidencing mechanism can include a first foil cover 70 with adhesive applied to one surface that can be adhered to the front of the filter cartridge 14 over the inlet opening 40, thereby sealing the opening. The cover 70 has a large tab 72 which can be grasped by the fire fighter to pull the cover 70 off of the filter cartridge in order to use the air filtering device 10. As shown in FIG. 3B, the mouthpiece 18 has a similar second cover 74 extending over the opening 76 in the flange 22 that couples with the tube 20. The second cover 74 is a foil material with a self-adhesive backing that adheres the cover to the surface of the flange 22 providing an air tight seal over the opening 76. The second cover 74 also has a large tab 78 that can be grasped by the fire fighter to pull the second cover 74 from the mouthpiece. The covers 70 and 74 seal the openings of the air filtering device 10 prior to use, thereby preventing moisture from entering the filter cartridge 14 and degrading the charcoal filter element 46 therein. The covers 70 and 74 can be removed easily in an emergency situation by a fire fighter wearing gloves.

The adhesive used to apply the two covers to the air filtering device should be of a type which loses its adhesion characteristic upon removal. In other words, the adhesive does not permit the covers 70 and 74 to be reattached to the mouthpiece, thus providing an indication that the mouthpiece has been used. Alternatively, the covers 70 and 74 can be made of use-evidencing tape to show that the container has been opened.

As previously mentioned, hoodless, smoke filtering apparatus is generally prohibited by most fire departments. To restrict use of this apparatus to only imminent life-threatening situations, the air filtration device 10 can enclosed in a use-evidencing package 80 illustrated in FIG. 4.

A fire fighter can quickly assess whether a filter has previously been used and possibly depleted or diminished. This rapid inspection can avoid the damage of using a possibly ineffective filter in a noxious atmosphere.

Also, periodically, fire department supervisory officials can inspect the packages of filtering devices which have been issued to the fire fighters to determine whether the devices have been used. If such use is detected, the respective fire fighter can be questioned as to the circumstances of such use to insure that the device had been used only in an emergency situation, such as after the depletion or the failure of authorized self-contained breathing equipment. The fire department may impose sanctions against fire fighters who use the subject breathing device 10 in other than authorized situations.

The package 80 can include an inner foil pack 82 in which the air filtering device 10 is placed. The foil pack 82 then is evacuated and sealed along a closure 84. A pair of tabs 86 extend from each side of the closure 84 providing mechanisms by which fire fighter can easily pull apart the closure and gain access to the air filtering device contained in foil pack 82. Because the foil pack 82 is vacuum sealed, it conforms to the external contours of the air filtering device 10. Upon opening the foil pack 82, the vacuum seal is lost and the pack no longer tightly conforms to the contours of the air filtering device. This provides a further mechanism in addition to the non-resealable closure 84 by which a user and a fire department supervisor can detect that the package 80 was opened.

Because the foil pack 82 is subject to accidental puncture if left exposed, the pack can be enclosed in a heavier gauge, puncture resistant transparent plastic bag 88. This bag may include mechanisms (not shown) for fastening the package 80 to fire fighting gear, such as a belt 87, conventional self-contained breathing equipment or a turn-out coat. In other cases, the pack 80 may simply be placed within a pocket 89 of the turn-out coat. An opening of bag 88 is thermally sealed along seam 90 in a manner which leaves an open section 92 which can be grasped by the fire fighter to pull apart the sealed seam 90, thereby gaining access at the foil pack 82. The closures of foil pack and bag 88 are designed to release easily so that access to the breathing device will not be significantly impeded in imminent life-threatening situations.

Figure 5:
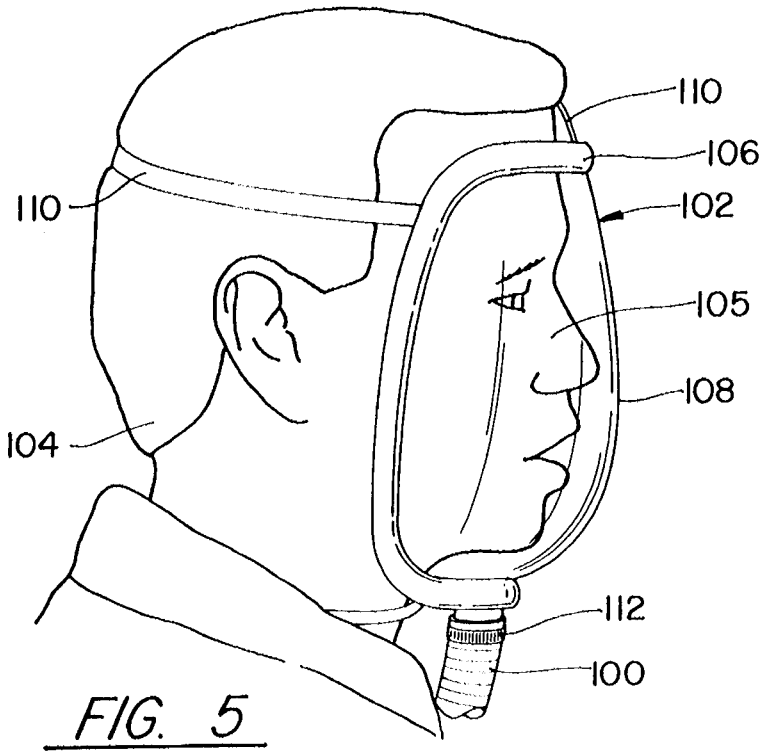
FIG. 5 is a pictorial view of a fire fighter wearing a mask of a conventional self contained breathing apparatus.

Other forms of use-evidencing containers can be used to store the air filtering device. Another version of the air filtering device for use in the method to save fire fighters in imminent life-threatening situations can be used with conventional fire fighter breathing equipment, such as the one shown in FIG. 5. This embodiment is preferred because it enables the fire fighter to leave his eye and face protecting mask on and quickly apply a filter in place of the hose and regulator for a self-contained breathing tank.

Fire fighters commonly wear self-contained breathing apparatus comprising a tank of compressed air (not shown) that is worn on the person's back. A hose 100 extends from the tank to a regulator (not shown) on the mask 102 worn over the face 105 of the fire fighter 104. The mask 102 has a ring 106 of resilient material such as rubber that conforms to contours of the user's head to provide a relatively air-tight seal when held in place by a set of elastic straps 110 that go around the head. A clear plastic window 108 projects like a bubble from the ring 106 in front of the face 105 of the fire fighter 104. The hose 100 (and regulator) connects to a fitting 112 or similar interface at the bottom of the mask 102, thereby supplying air to the envelope formed by the mask and the fire fighter's face 105.

It should be understood that the description of the face mask and air supply assembly is intended to be illustrative of a typical configuration. The method of the invention can be applied to a wide variety of fire fighter's self-contained breathing systems to allow a fire fighter to obtain extra lifesaving minutes of breathing.

Figure 6:
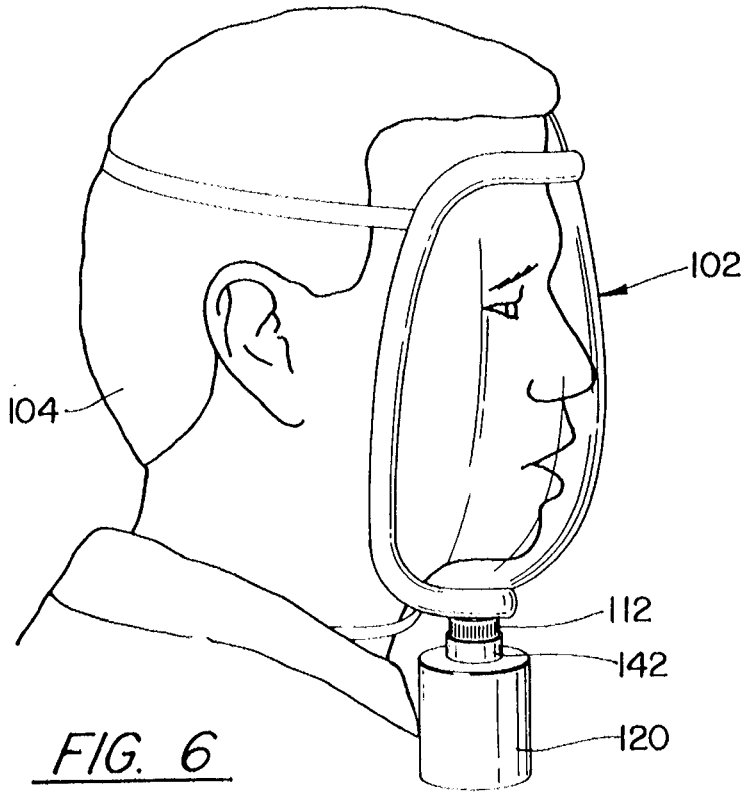
FIG. 6 is a pictorial view of a fire fighter wearing the mask of FIG. 5 which is attached to an emergency air filtering system according to the present invention.

With reference to FIG. 6, in the event that the fire fighter is unable to exit a burning structure before the exhaustion of the air supply in the tank, the hose 100 and regulator can be disconnected from the mask 102 and an emergency air filtering device 120 attached to the interface of the mask 102. The emergency air filtering device 120 normally is stored on the fire fighter by fastening to fire fighting gear, such as the standard breathing equipment or a turn-out coat from which the device can be readily accessed in an emergency. Also, the filter can be stored in a pocket of a turn-out coat.

Figure 7:
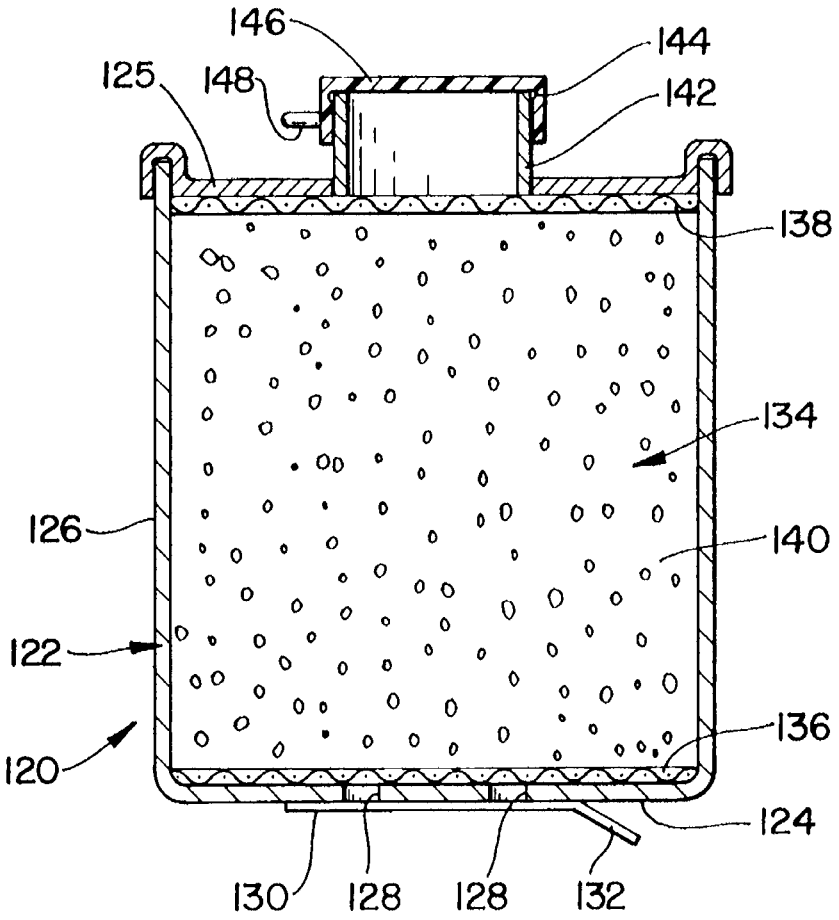
FIG. 7 is a cross-sectional view through the emergency air filtering system.

As shown in FIG. 7 the emergency air filtering device 120 can comprise a canister 122 having a cylindrical container 126 and a lid 125 sealed to an open end of the container. The other end of container 126 can be closed by a contiguous bottom wall 124 which has a plurality of apertures 128 therethrough. Use-evidencing tape 130 can be adhered to the exterior surface of the bottom wall 124 closing the apertures 128. The tape 130 prevents air from entering the canister 122 when not in use, thereby preserving a filter element 134 contained therein. The tape 130 has a tab 132 which is grasped by a fire fighter to remove the tape in order to use the air filtering device 120. The releasable adhesive used to attach the tape 130 to the canister is of the type that can not be reused once the tape has been removed, thus providing evidence that the canister has been opened. Alternatively, the canister 122 can be enclosed in a use-evidencing container as discussed above in connection with the mouthpiece embodiment.

The filter element 134 within the canister 122 can have a separate fabric filter 136 and 138 against the bottom wall 124 and the lid 125 respectively. Between the two fabric filters 136 and 138 is an activated charcoal filter 140. Alternatively, a multiple stage filter can be placed between the fabric filters. For example, in addition to an activated charcoal filter, a desiccant can be provided to remove moisture and a material that converts carbon monoxide into carbon dioxide by catalyzation may be included. While the filter can be constructed in a variety of ways, it is preferred that the filter be equipped to clean air filled with high levels of carbon monoxide, for example, through the use of hopkolite and silica gel. The filter cartridge could also be constructed in a more compact, puck-like container.

The lid 125 is tightly attached to the container 126 by crimping or adhesive so that air can not leak therebetween. An aperture extends centrally through the lid 125 and a tubular coupling 142 is sealed to the lid in communication with the aperture. The coupling 142 has an external lip 144 at the remote end. A cap 146, of soft plastic for example, is placed over the remote end of the coupling 142 to seal that end of the canister 122 when not in use. A tab 148 allows the cap 146 to be peeled away in order to use the air filtering device 120. The cap 146 is destroyed by the removal process thereby preventing use of the cap to reseal the coupling. Thus, cap 146 can also serve as a mechanism which provides evidence of the use of the filtering device 120. The single use covers formed by tape 130 and cap 146 not only prevent a contaminated air filtering device 120 from being inadvertently reused, but also provides a mechanism by which fire department officials can detect the unauthorized use of the emergency air filtering device.

When the emergency air filtering device 120 is to be used, the fire fighter removes the tape 130 and the cap 146 from the ends of the canister 122. The coupling 142 then is attached to the fitting 112 on the mask 102 in place of the hose 100 and regulator as shown in FIG. 6. The coupling is preferably constructed to engage the fitting in sealed manner to prevent smoke from entering the interior of the face mask. The fire fighter then is able to breathe filtered air through the canister of the device 120. Alternatively, the filter cap 146 can be formed of a breakable tape that is permanently punctured upon engagement of the coupling 142 onto the interface 112.

Figure 8:
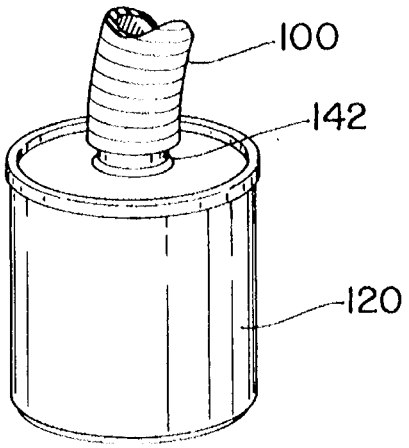
FIG. 8 illustrates the emergency air filtering system attached to a hose of a mask for a standard breathing apparatus.

Alternatively, the hose 100 could remain attached to the mask 102 and the emergency air filtering device 120 could connected by coupling 142 to the remote end of the hose as shown in FIG. 8. However, this method is not preferred because of the difficulty that may be encountered in attempting to disconnect the remote end of the hose from the tank.

Figure 4:
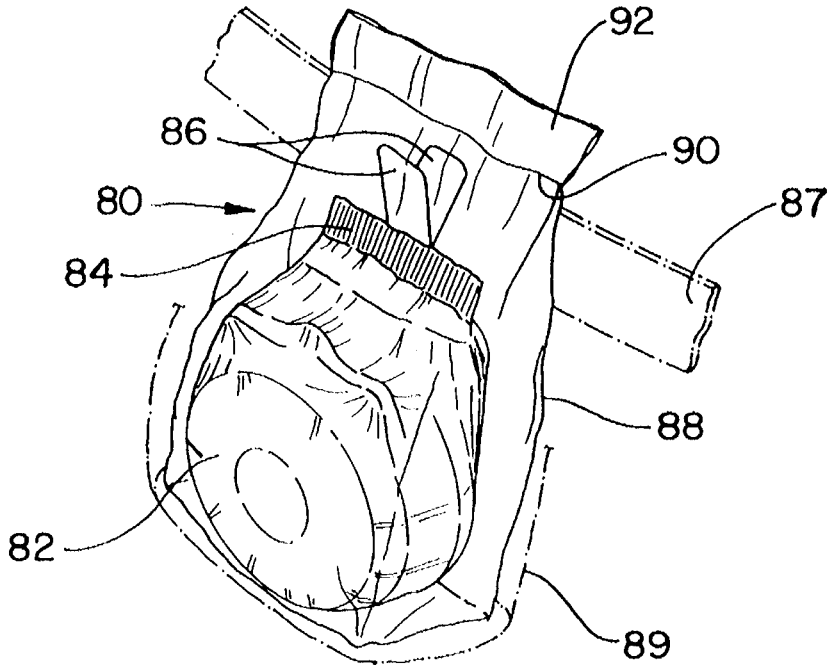
FIG. 4 shows the emergency breathing apparatus enclosed in another use-evidencing container embodiment.

The emergency air filtering device 120 also can be enclosed in a use-evidencing package, such as package 80 illustrated in FIG. 4 and described previously. The use of that type of package may be in addition to or in place of the canister closures provided by tape 130 and cap 146.

While specific embodiments of the invention have been set forth with a relatively high degree of particularity, it is intended that the scope of the invention not be so limited. Instead, the proper scope of the invention may include alternatives which are now within the purview of one skilled in the art. Thus, the scope should be ascertained by a reading of the claims that follow.

We claim:

1. A method for storing and preparing a personal air filtering device for smoke inhalation protection for fire fighters in imminently life-threatening situations and for encouraging its limited use to the imminently life-threatening situations, said method comprising the steps of:

configuring a smoke filter in a use-evidencing manner so that use of the smoke filter for breathing is permanently indicated;

equipping the fire fighter with a self-contained breathing apparatus including a face mask connected by a conduit to a tank of breathable air;

interfacing the smoke filter with the fire fighter's face mask to filter air breathed by the fire fighter when the tank of breathable air is depleted.

2. A method as recited in claim 1, further comprising the step: before the interfacing step, storing the smoke filter in the fire fighter's coat.

3. A method as recited in claim 1, further comprising the step: before the interfacing step, storing the smoke filter on a fire fighter's belt.

4. A method as recited in claim 1, further comprising the step: before the interfacing step, removing a regulator and hose from the fire fighter's face mask, wherein the smoke filter sealingly interfaces the face mask during said interfacing step to prevent smoke from entering the interior of the face mask.

5. The method as recited in claim 3, wherein the use-evidencing covers are attached to the inlet and outlet by non-readhering adhesives.

6. A method for storing and preparing a personal air filtering device for smoke inhalation protection for a fire fighter in imminently life-threatening situations and for encouraging its limited use by the fire fighter to the imminently life-threatening situations, said method comprising the steps of:

configuring a smoke filter with a use-evidencing mechanism so that use of the smoke filter for breathing is permanently indicated;

providing the smoke filter to a fire fighter for use in an imminently life-threatening situation;

providing the fire fighter with a self-contained breathing apparatus including a face mask connected by conduit to a tank of breathable air for primary use during exposure to a non-breathable environment;

said fire fighter primarily using said self-contained breathing apparatus in a non-breathable environment and transporting the smoke filter into said non-breathable environment;

said fire fighter depleting an air supply in the self-contained breathing apparatus;

said fire fighter disconnecting the face mask from the tank of breathable air;

said fire fighter breaching said use-evidencing mechanism to access said smoke filter, whereby use of said smoke filter is evidenced;

said fire fighter interfacing the smoke filter with the fire fighter's face mask to filter air breathed by the fire fighter through the smoke filter;

after exiting the non-breathable environment, a third party inspecting the use-evidencing mechanism; and said fire fighter accounting for use of said smoke filter.

7. A method for storing and preparing a personal air filtering device for smoke inhalation protection for a fire fighter in imminently life-threatening situations and for encouraging its limited use by the fire fighter to the imminently life-threatening situations, said method comprising the steps of:

configuring a smoke filter with a use-evidencing mechanism so that use of the smoke filter for breathing is permanently indicated;

providing the smoke filter to a fire fighter for use in an imminently life-threatening situation;

providing the fire fighter with a self-contained breathing apparatus including a face mask connected by conduit to a tank of breathable air for primary use during exposure to a non-breathable environment;

said fire fighter primarily using said self-contained breathing apparatus in a non-breathable environment and transporting the smoke filter into said non-breathable environment;

said self-contained breathing apparatus failing to provide breathable air to said fire fighter;

said fire fighter disconnecting the face mask from the tank of breathable air;

said fire fighter breaching said use-evidencing mechanism to access said smoke filter, whereby use of said smoke filter is evidenced;

said fire fighter interfacing the smoke filter with the fire fighter's face mask to filter air breathed by the fire fighter through the smoke filter;

after exiting the non-breathable environment, a third party inspecting the use-evidencing mechanism; and said fire fighter accounting for use of said smoke filter.

8. A method for storing and preparing a personal air filtering device for smoke inhalation protection for a fire fighter in imminently life-threatening situations and for encouraging its limited use by the fire fighter to the imminently life-threatening situations, said method comprising the steps of:

placing a hoodless, compact mouthpiece and smoke filter in a use-evidencing container;

providing the hoodless compact mouthpiece and smoke filter in a use-evidencing container to a fire fighter for use in an imminently life-threatening situation;

providing the fire fighter with a self-contained breathing apparatus for primary use during exposure to a non-breathable environment;

said fire fighter primarily using said self-contained breathing apparatus in a non-breathable environment and transporting the hoodless compact mouthpiece and smoke filter in a use-evidencing container into said non-breathable environment;

said self-contained breathing apparatus failing to provide breathable air to said fire fighter;

said fire fighter breaching said use-evidencing container to access said hoodless compact mouthpiece and smoke filter, whereby use of said hoodless compact mouthpiece and smoke filter is evidenced;

said fire fighter using said hoodless compact mouthpiece and smoke filter to breathe within said non-breathable environment;

after exiting the non-breathable environment, inspecting the use-evidencing container by a third party; and accounting for use of said hoodless compact mouthpiece and smoke filter by said fire fighter.

9. The method as recited in claim 8, wherein the use-evidencing container is an air-evacuated foil wrapper.

10. A method for storing and preparing a personal air filtering device for smoke inhalation protection for a fire fighter in imminently life-threatening situations and for encouraging its limited use by the fire fighter to the imminently life-threatening situations, said method comprising the steps of:

covering an inlet of a hoodless smoke filter and an outlet of an associated mouthpiece with use-evidencing removable covers;

providing the hoodless compact mouthpiece and smoke filter with use-evidencing covers to a fire fighter for use in an imminently life-threatening situation;

providing the fire fighter with a self-contained breathing apparatus for primary use during exposure to a non-breathable environment;

said fire fighter primarily using said self-contained breathing apparatus in a non-breathable environment and transporting the hoodless compact mouthpiece and smoke filter with use-evidencing covers into said non-breathable environment;

said self-contained breathing apparatus failing to provide breathable air to said fire fighter;

said fire fighter breaching said use-evidencing container to access said hoodless compact mouthpiece and smoke filter whereby use of said hoodless compact mouthpiece and smoke filter is evidenced;

said fire fighter using said hoodless compact mouthpiece and smoke filter to breathe within said non-breathable environment;

after exiting the non-breathable environment, inspecting the use-evidencing covers by a third party; and accounting for use of said hoodless compact mouthpiece and smoke filter by said fire fighter.

11. A method for storing and preparing a personal air filtering device for smoke inhalation protection for a fire fighter in imminently life-threatening situations and for encouraging its limited use by the fire fighter to the imminently life-threatening situations, said method comprising the steps of:

equipping a hoodless, compact mouthpiece and smoke filter with a use-evidencing mechanism wherein use of the hoodless, compact mouthpiece and smoke filter is visually and irrevocably detectable once used;

providing the hoodless compact mouthpiece and smoke filter with use-evidencing mechanism to a fire fighter for possible use in an imminently life-threatening situation;

providing the fire fighter with a self-contained breathing apparatus for primary use during exposure to a non-breathable environment;

said fire fighter primarily using said self-contained breathing apparatus in a non-breathable environment and transporting the hoodless compact mouthpiece and smoke filter with a use-evidencing mechanism into said non-breathable environment;

said self-contained breathing apparatus failing to provide breathable air to said fire fighter;

said fire fighter breaching said use-evidencing mechanism to access said hoodless compact mouthpiece and smoke filter whereby use of said hoodless compact mouthpiece and smoke filter is evidenced;

said fire fighter using said hoodless compact mouthpiece and smoke filter to breathe within said non-breathable environment;

after exiting the non-breathable environment, inspecting the use-evidencing mechanism by a third party; and accounting for use of said hoodless compact mouthpiece and smoke filter by said fire fighter.

12. The method as recited in claim 11, further comprising the step of:

after accounting for the use of the smoke filter, documenting said use.

13. The method as recited in claim 11, wherein said use-evidencing mechanism comprises a first cover adhesively applied over the opening in said mouthpiece and a second cover adhesively applied over the aperture of said filter, wherein adhesive employed to hold the first and second covers in place cannot be used to reapply said first and second covers after removal.

14. The method as recited in claim 11, wherein said use-evidencing mechanism comprises a first cover adhesively applied over the opening in said mouthpiece and a second cover adhesively applied over the aperture of said filter, each of said first and second covers having a tab for grasping by a user to aid in removing that respective cover and having an indicator which denotes removal from one of said mouthpiece and said filter.

15. The method as recited in claim 11, wherein said use-evidencing mechanism comprises a container which encloses said mouthpiece and said filter and having a closure that inhibits reclosing to thereby provide an indication that the container has been opened.

16. The method as recited in claim 15, wherein said container comprises a bag.

17. The method as recited in claim 15, wherein said container comprises an air evacuated enclosure.

18. The method as recited in claim 17, wherein said container further comprises a bag having a seam which defines a sealed first portion containing said enclosure and an open second portion which has flaps that can be grasped by a user to aid in opening the seam to gain access to said enclosure.

* * * * *